US011248751B2

(12) United States Patent
Cao et al.

(10) Patent No.: US 11,248,751 B2
(45) Date of Patent: Feb. 15, 2022

(54) LED LIGHTING APPARATUS

(71) Applicant: XIAMEN ECO LIGHTING CO. LTD., Xiamen (CN)

(72) Inventors: Liangliang Cao, Xiamen (CN); Wei Liu, Xiamen (CN); Feihua He, Xiamen (CN); Fengyu Yan, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/017,591

(22) Filed: Sep. 10, 2020

(65) Prior Publication Data

US 2020/0408363 A1 Dec. 31, 2020

Related U.S. Application Data

(63) Continuation of application No. 16/405,509, filed on May 7, 2019, now Pat. No. 10,801,675.

(30) Foreign Application Priority Data

Feb. 14, 2019 (CN) ..... 201821867771.0

(51) Int. Cl.

| | |
|---|---|
| ***F21K 9/232*** | (2016.01) |
| ***F21V 23/00*** | (2015.01) |
| ***H05B 45/00*** | (2020.01) |
| ***H05B 47/19*** | (2020.01) |

(52) U.S. Cl.

CPC ..... *F21K 9/232* (2016.08); *F21V 23/005* (2013.01); *F21V 23/009* (2013.01); *H05B 45/00* (2020.01); *H05B 47/19* (2020.01)

(58) Field of Classification Search

CPC ..... F21K 9/232; F21K 9/278; F21K 9/238; F21V 23/005; F21V 23/0435; F21V 23/009; H05B 45/00; H05B 45/30; H05B 45/40; H05B 47/19

See application file for complete search history.

(56) References Cited

U.S. PATENT DOCUMENTS

| | | | | |
|---|---|---|---|---|
| 9,039,243 | B2 * | 5/2015 | Ju | F21V 7/00 362/294 |
| 9,253,859 | B2 * | 2/2016 | Chung | F21V 29/773 |
| 9,404,624 | B2 * | 8/2016 | Chung | F21V 29/763 |
| 9,559,407 | B2 * | 1/2017 | Van Dijk | H01Q 1/02 |
| 10,801,675 | B2 * | 10/2020 | Cao | H05B 45/00 |
| 2015/0345764 | A1 * | 12/2015 | Hussey | H05B 33/00 362/235 |
| 2016/0227636 | A1 * | 8/2016 | Sun | F21V 29/74 |

* cited by examiner

*Primary Examiner* — Mariceli Santiago

(74) *Attorney, Agent, or Firm* — Chun-Ming Shih; Lanway IPR Services

(57) ABSTRACT

A smart LED lighting apparatus with communication capabilities. The lighting apparatus includes a main body, a bulb body, a head body, a LED module for emitting light, and a communication module for providing wireless communication. The bulb body is connected to a first end of the main body. The head body is connected to a second end of the main body and configured to be connected to an electrical socket for receiving power. The lighting apparatus further includes a composite printed circuit board having a first sub-board and a second sub-board physically coupled to the first sub-board. The communication module is located on the first sub-board and the light LED module is located on the second sub-board.

12 Claims, 7 Drawing Sheets

LED LIGHTING APPARATUS

FIELD

The present invention is related to an LED lighting apparatus, and more particularly related to a smart LED lighting apparatus with wireless communication capabilities.

BACKGROUND

With the rapid development of LED technology, LED lighting has gradually become the one of the favorite choices for environment-friendly lighting apparatuses. It is appreciated that LED lighting products are superior to traditional lighting products in terms of lighting principle, energy saving and environmental protection. Nevertheless, most of the traditional lamps mainly focus on illumination, with no or only very few additional functions. In particular, the operational mode of the traditional lamps cannot be easily switched by users. Therefore, it is desired to provide a better integrated smart LED lighting apparatus.

SUMMARY OF INVENTION

Compared with the conventional technology, one embodiment of the present disclosure has the communication module and the LED module arranged on a single board, and thus the components required are simplified. The LED module is configured to provide light, without being blocked by other metal structure or electronic components. Such configuration also contributes to the performance of transmitting and receiving signals by the communication module. Further, the LED lighting apparatus is provided with additional functions, such as dimming, RGBW color mixing, human body sensing and music playing. Compared with the traditional lighting apparatus, the LED lighting apparatus of the embodiment has been integrally designed, and may be easily automatically manufactured so as to reduce the production cost.

In an embodiment, the lighting apparatus includes a main body, a bulb body, a head body, a light emitting diode (LED) module for emitting light, and a communication module for providing wireless communication. The bulb body is connected to a first end of the main body. The head body is connected to a second end of the main body and configured to be connected to an electrical socket for receiving power. The lighting apparatus further includes a composite printed circuit board having a first sub-board and a second sub-board physically coupled to the first sub-board. The communication module is located on the first sub-board and the light LED module is located on the second sub-board.

In some embodiments, the communication module further includes an antenna, a radio frequency circuitry coupled to the antenna for receiving wireless signals, and a radio frequency power circuitry for providing power to the radio frequency circuitry.

In some embodiments, the radio frequency circuitry further includes a radio frequency integrated circuit and an antenna impedance matching circuitry electrically connected to the antenna.

In some embodiments, the radio frequency integrated circuit further includes a crystal oscillator and a flash memory.

In some embodiments, the radio frequency circuitry further includes a radio frequency integrated circuit, a crystal oscillator, a flash memory, and an antenna impedance matching circuitry electrically connected to the antenna.

In some embodiments, the light LED module further includes one or a plurality of light emitting diodes, and also a driver circuitry electrically connected to the light emitting diodes to enable the light emitting diodes to emit light.

In some embodiments, the main body further includes a plastic coated aluminum structure.

In some embodiments, the first sub-board and the second sub-board includes different substrates.

In some embodiments, the first sub-board includes an insulating substrate, and the second sub-board includes a metal substrate.

In some embodiments, the second sub-board physically surrounds the first sub-board, and the first sub-board and the second sub-board are physically arranged in a same plane.

In some embodiments, the first sub-board includes a first layer and a second layer physically arranged above the first layer, and the first layer of the first sub-board and the second sub-board are physically arranged in a same plane.

In some embodiments, the communication module includes an antenna, a radio frequency circuitry coupled to the antenna for receiving wireless signals, and a radio frequency power circuitry for providing power to the radio frequency circuitry. Particularly, the radio frequency power circuitry is arranged on the first layer of the first sub-board, and the antenna and the radio frequency circuitry are arranged on the second layer of the first sub-board.

In some embodiments, the first sub-board includes a first layer, a second layer physically arranged above the first layer, and a third layer physically arranged above the second layer. Particularly, the first layer of the first sub-board and the second sub-board are physically arranged in a same plane.

In some embodiments, the communication module includes an antenna, a radio frequency circuitry coupled to the antenna for receiving wireless signals, and a radio frequency power circuitry for providing power to the radio frequency circuitry. Particularly, the antenna and the radio frequency circuitry are arranged in a first plane, and the radio frequency power circuitry is arranged in a second plane different from the first plane.

In some embodiments, the communication module includes an antenna, a radio frequency circuitry coupled to the antenna for receiving wireless signals, and a radio frequency power circuitry for providing power to the radio frequency circuitry. Particularly, the radio frequency power circuitry is arranged on the first layer of the first sub-board, the radio frequency circuitry is arranged on the second layer of the first sub-board, and the antenna is arranged on the third layer of the first sub-board.

In another embodiment, the lighting apparatus includes a main body, a bulb body, a head body, an light LED module for emitting light, and a communication module for providing wireless communication. The bulb body is connected to a first end of the main body. The head body is connected to a second end of the main body, and is configured to be connected to an electrical socket for receiving power. The lighting apparatus further includes a composite printed circuit board having a first sub-board and a second sub-board physically surrounds the first sub-board. The communication module is located on the first sub-board, and the light LED module is located on the second sub-board. The main body includes an annular holder structure configured to hold the composite printed circuit board.

In some embodiments, the communication module includes an antenna, a radio frequency circuitry coupled to the antenna for receiving wireless signals, and a radio frequency power circuitry for providing power to the radio frequency circuitry.

In some embodiments, the radio frequency circuitry further comprises a radio frequency integrated circuit and an antenna impedance matching circuitry electrically connected to the antenna.

In some embodiments, the radio frequency integrated circuit further comprises a crystal oscillator and a flash memory.

In some embodiments, the radio frequency circuitry further comprises a radio frequency integrated circuit, a crystal oscillator, a flash memory, and an antenna impedance matching circuitry electrically connected to the antenna.

DETAILED DESCRIPTION

The present disclosure will be further described in detail below with reference to the accompanying drawings and embodiments. It is understood that the specific embodiments described herein are merely illustrative of the claimed invention and are not intended to limit the claimed invention.

Figure 1:
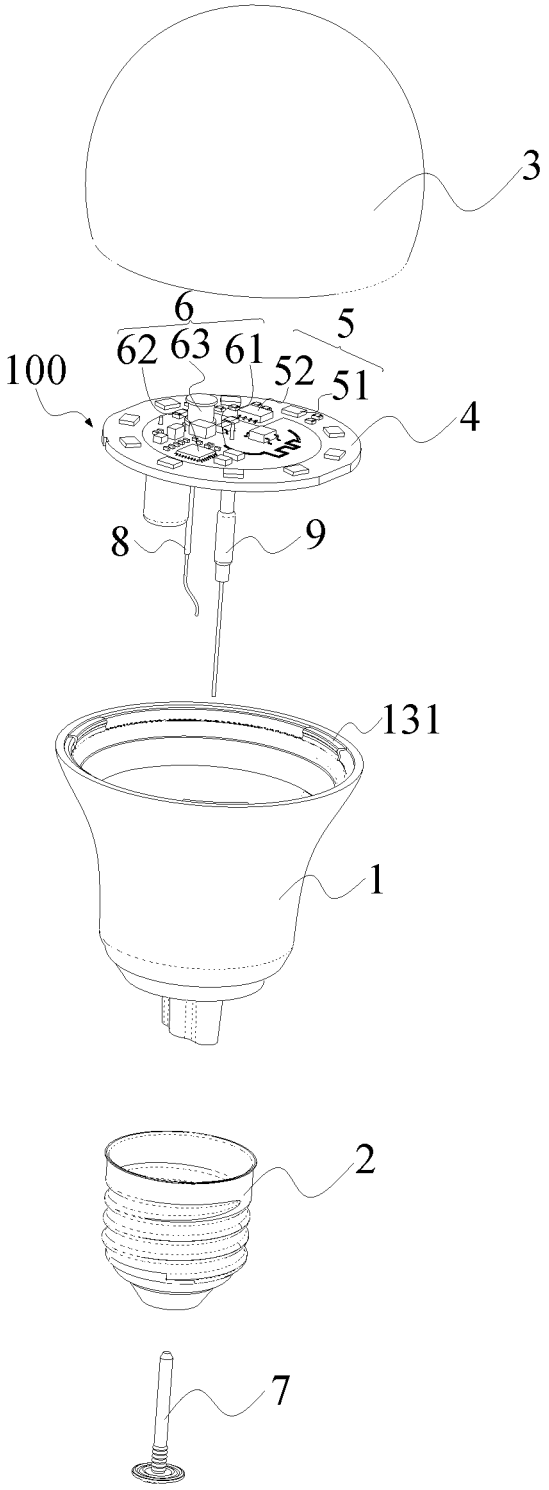
FIG. 1 is an exploded view of the LED lighting apparatus in accordance with one embodiment of the present disclosure.
Figure 2:
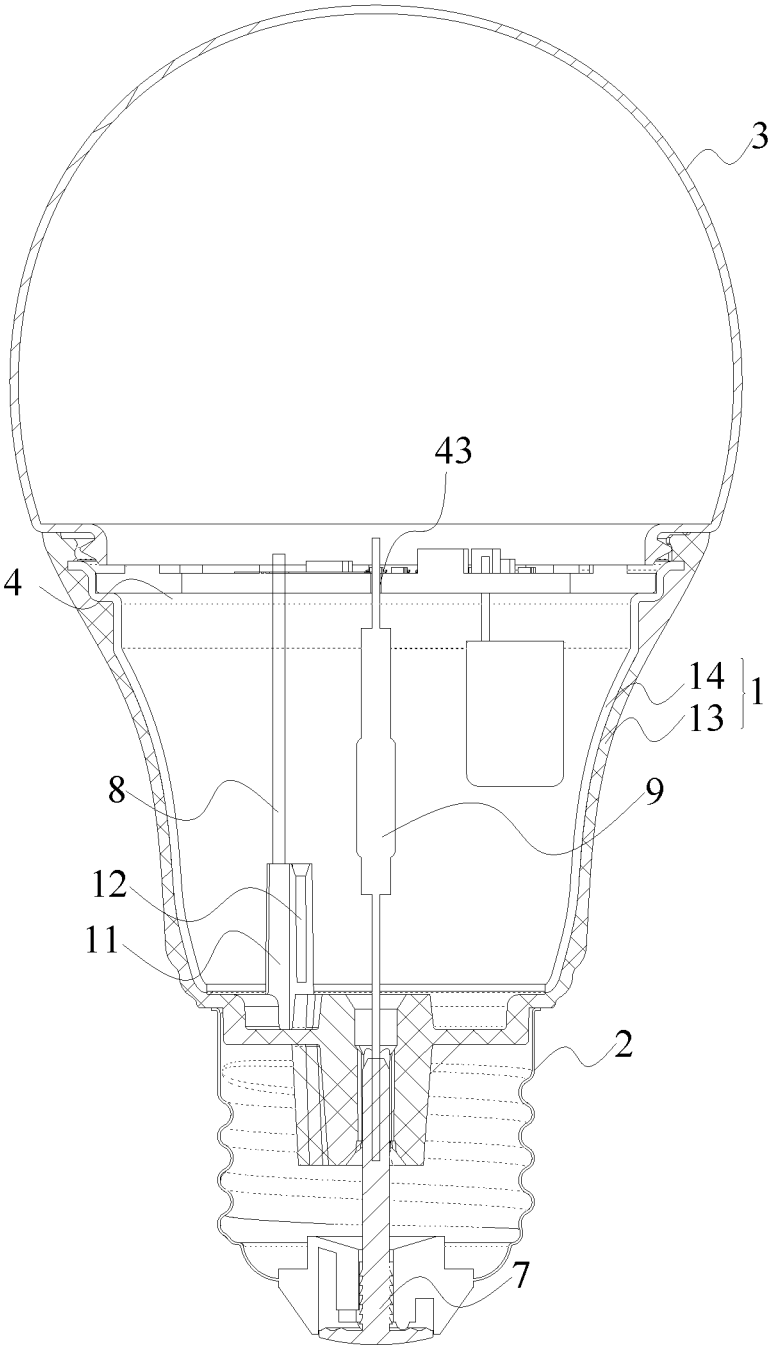
FIG. 2 is a sectional view of the LED lighting apparatus in accordance with one embodiment of the present disclosure.

Refer to FIG. 1 and FIG. 2. In one embodiment, the lighting apparatus includes a main body 1, a bulb body 3, a head body 2, a light emitting diode (LED) module 5 for emitting light, and a communication module 6 for providing wireless communication.

The main body 1 may include a plastic coated aluminum structure. The bulb body 3 is connected to a first end of the main body 1. The head body 2 is connected to a second end of the main body 1 and configured to be connected to an electrical socket for receiving power. The lighting apparatus further includes a composite module 100. The composite module 100 includes a composite printed circuit board 4, a light LED module 5, and a communication module 6. The light LED module 5 and the communication module 6 are electrically connected via the composite printed circuit board 4. The composite printed circuit board 4 having a first sub-board 41 and a second sub-board 42 physically coupled to the first sub-board 41. The communication module 6 is located on the first sub-board 41 and the light LED module 5 is located on the second sub-board 42.

The light LED module 5 includes one or a plurality of light emitting diodes (LEDs) 51, and also a driver circuitry 52 electrically connected to the light emitting diodes 51 to enable the light emitting diodes 51 to emit light.

Figure 3:
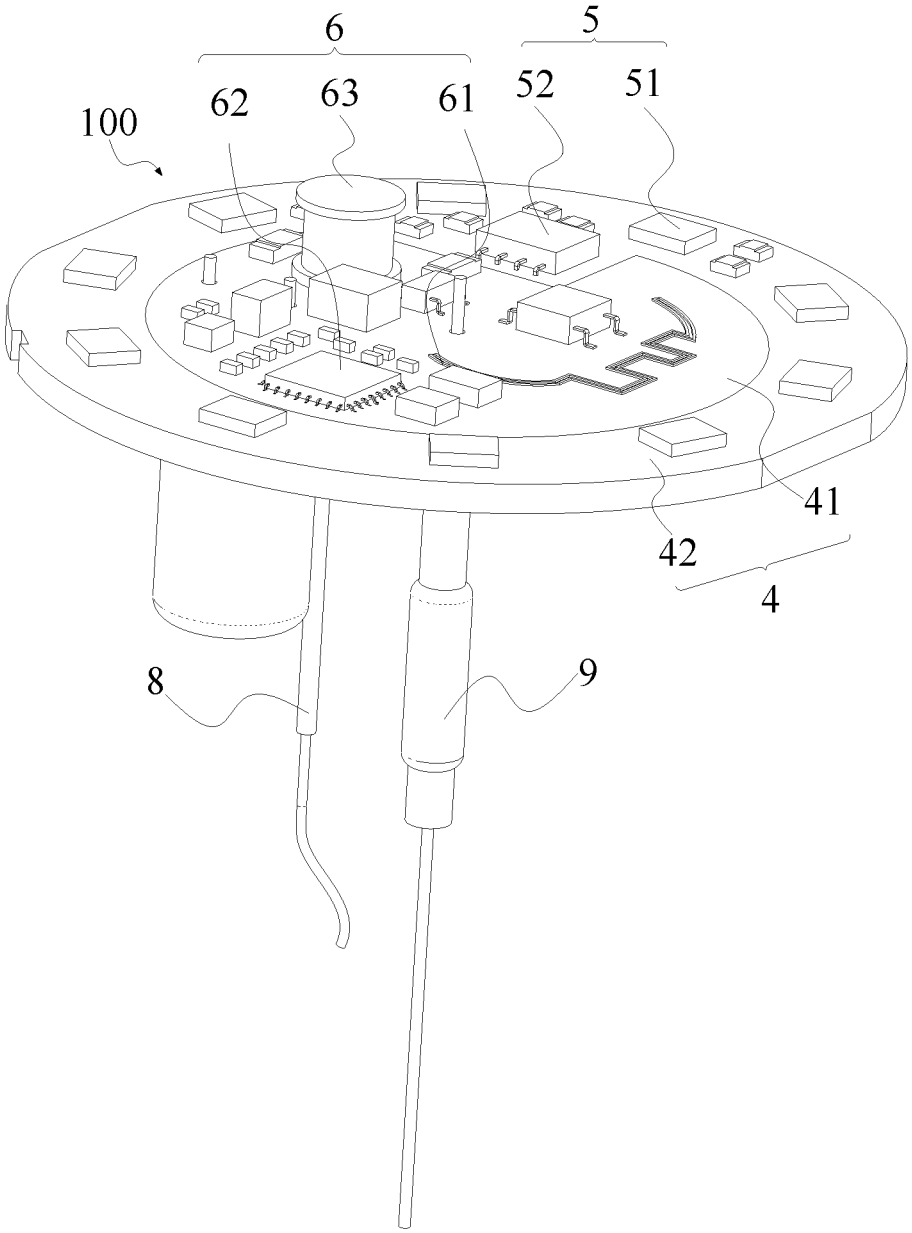
FIG. 3 is a three-dimensional view of the composite module in accordance with a first embodiment of the present disclosure.

Referring to FIGS. 1-3, the composite printed circuit board 4, the LED module 5, and the communication module 6 are arranged within the main body 1 and the bulb body 3. The main body 1 is made of plastic coated aluminum structure. That is, the main body 1 includes a plastic insulating portion 13 and a conductive portion 14 made of aluminum. The conductive portion 14 is capable of dissipating heat. The bulb body 3 is bulb-shaped to facilitate the LED module 5 emitting light efficiently. In one embodiment, the bulb body 3 is transparent, and may be made of plastic materials, such as PVC (Polyvinyl chloride, polyvinyl chloride) or PET (Polyethylene terephthalate).

The LED lighting apparatus also includes a metal piece 7 and an edge line 8. The metal piece 7 is pin-shaped and is configured to pass through the head body 2. The outer wall of the head body 2 is provided with external thread, thus the metal piece 7 may be electrically connected to an external power source so as to supply the current to the composite printed circuit board 4. The metal piece 7 may directly connect to terminals on the composite printed circuit board 4 (not shown) when the length of the metal piece 7 is long enough, such that the metal piece 7 is electrically connected to the composite printed circuit board 4.

In one embodiment, the edge line 8 is arranged on the surface of the composite printed circuit board 4 facing away from the bulb body 3. The edge line 8 electrically connects to the head body 2 via the main body 1.

In one embodiment, the bottom of the main body 1 is configured with a protrusion 11 extending from an edge of the bottom toward the edge line 8. The protrusion 11 is provided with a socket 12 for engaging with the edge line 8. That is, the composite printed circuit board 4 electrically connects to the head body 2 via the metal piece 7 and the edge line 8.

In one embodiment, when the length of the metal piece 7 is not long enough for the metal piece 7 to reach the composite printed circuit board 4, a resistance line 9 may be configured on one surface of the composite printed circuit board 4 facing toward the metal piece 7, and the resistance line 9 electrically connects to the metal piece 7. In one embodiment, a central area of the composite printed circuit board 4 is provided with a through hole 43 or an opening. The resistance line 9 operates as a fire wire to pass through the through hole 43 or the opening of the head body 2 so as to electrically connect to the metal piece 7. The composite printed circuit board 4 is subjected to wave soldering together with the edge line 8 and the resistance line 9. Afterward, the resistance line 9 and the edge line 8 are connected to the composite printed circuit board 4 by solder paste.

Referring to FIGS. 1, 3, 4 and 5, the composite printed circuit board 4 is of single-layer. The communication module 6 and the LED module 5 are welded on the composite printed circuit board 4. That is, the communication module 6 and the LED module 5 are welded on the surface of the composite printed circuit board 4 facing toward the bulb body 3.

An internal wall of the main body 1 is configured with a ring-shaped stage 131. The composite printed circuit board 4 engages with the ring-shaped stage 131. The composite printed circuit board 4 is a composite board made by a metal substrate and an insulating substrate.

The composite printed circuit board 4 includes a first sub-board 41 and a second sub-board 42. The communication module 6 is arranged on the first sub-board 41, and the LED module 5 is arranged on the second sub-board 42. The first sub-board and the second sub-board are different substrates. For instance, the first sub-board 41 is an insulating substrate, and the second sub-board 42 is a metal substrate.

At least one surface of the first sub-board 41 and the second sub-board 42 includes an insulating layer (not shown) and a conductive layer (not shown). That is, both of the first sub-board 41 and the second sub-board 42 includes the insulating layer and the conductive layer. The conductive layer electrically connects the first sub-board 41 with the second sub-board 42. The insulating layer is configured for insulating the composite printed circuit board 4 and the conductive layer.

Referring to FIG. 3, the first sub-board 41 is embedded within the second sub-board 42 so as to form the composite substrate. As the first sub-board 41 and the second sub-board 42 are on the same plane, the communication module 6 and the LED module 5 are also on the same plane. As all components of the communication module 6 and the LED module 5 are on the same plane, such configuration may save space.

The first sub-board 41 and the second sub-board 42 both include the conductive layer. The resistance line 9 is arranged in the central area of the composite printed circuit board 4, that is, the resistance line 9 is arranged on the first sub-board 41 for providing power supply to the communication module 6. On the other hand, the LED module 5 may operate in accordance with the signals from the communication module 6. With such configuration, the feedback route of the signals from the communication module 6 to the LED module 5 may be easily configured.

Figure 4:
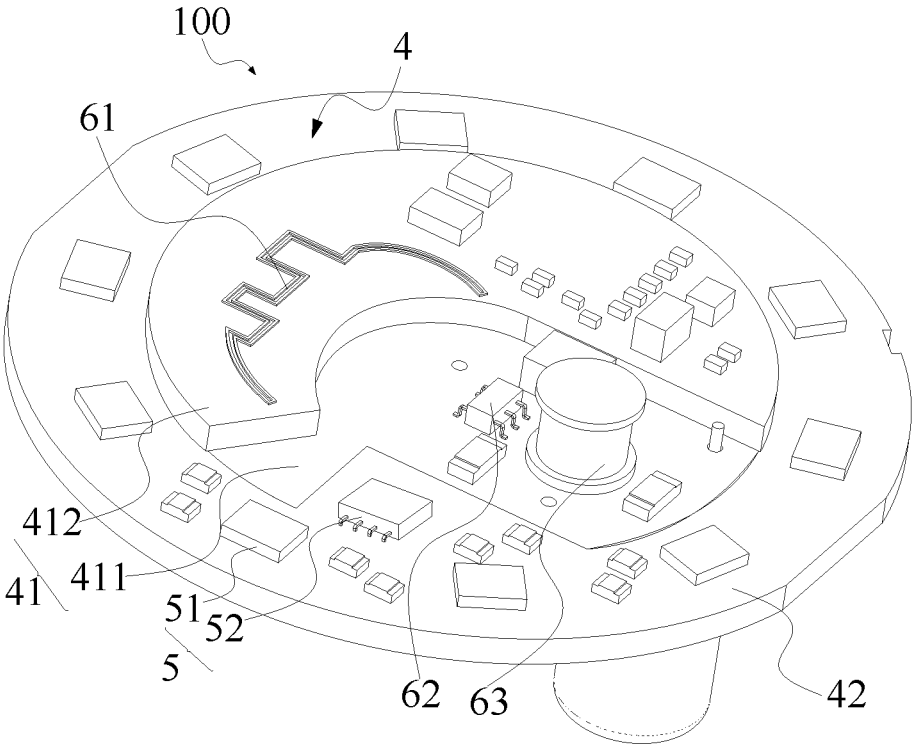
FIG. 4 is a three-dimensional view of the composite module in accordance with a second embodiment of the present disclosure.
Figure 5:
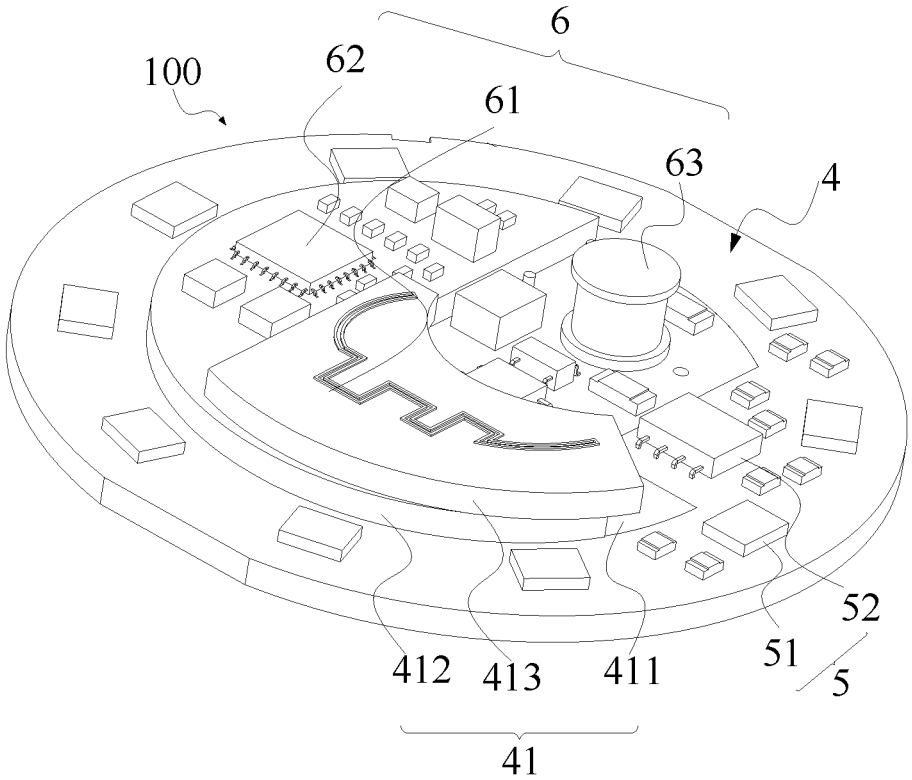
FIG. 5 is a three-dimensional view of the composite module in accordance with a third embodiment of the present disclosure.

Referring to FIGS. 4 and 5, in one embodiment, the communication module 6 and the LED module 5 may not be on the same plane. In some embodiments, the communication module 6 further includes an antenna 61, a radio frequency circuitry 62 coupled to the antenna 61 for receiving wireless signals, and a radio frequency power circuitry 63 for providing power to the radio frequency circuitry 62.

Referring to FIG. 4, the radio frequency circuitry 62 and the antenna 61 may be integrated as a module to be welded on the composite printed circuit board 4. Specifically, the first sub-board 41 includes a first layer 411 and a second layer 412 stacked together. The first layer 411 and the second layer 412 are on the same plane. The radio frequency power circuitry 63 is arranged on the first layer 411, and the antenna 61 and the radio frequency circuitry 62 are arranged on the second layer 412. That is, the radio frequency power circuitry 63 and the LED module 5 are on the same plane. To avoid signal interference, the second layer 412 is disposed away from the radio frequency power circuitry 63.

Referring to FIG. 5, in another embodiment, the antenna 61 may be configured externally, and the radio frequency circuitry 62 and the radio frequency power circuitry 63 may be separately arranged. Specifically, the first sub-board 41 includes the first layer 411, the second layer 412, and a third layer 413. The first layer 411 and the second sub-board 42 are on the same plane, and the radio frequency power circuitry 63 is arranged on the first layer 411. The radio frequency circuitry 62 is arranged on the second layer 412, and the antenna 61 is arranged on the third layer 413. The second layer 412 is disposed away from the radio frequency power circuitry 63, and the third layer 413 is disposed away from the radio frequency circuitry 62 and the radio frequency power circuitry 63 so as to avoid the signals interference.

Figure 7:
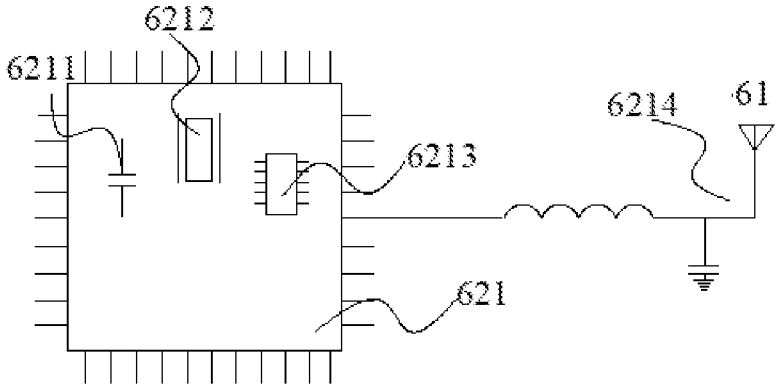
FIG. 7 is a circuit diagram of the radio frequency chip in accordance with one embodiment of the present disclosure.

Referring to FIG. 7, in some embodiments, the radio frequency circuitry 62 further includes a radio frequency integrated circuit 621 and an antenna impedance matching circuitry 6214 electrically connected to the antenna 61. The radio frequency integrated circuit 621 further includes a filter circuitry 6211, a crystal oscillator 6212 and a flash memory 6213.

Figure 6:
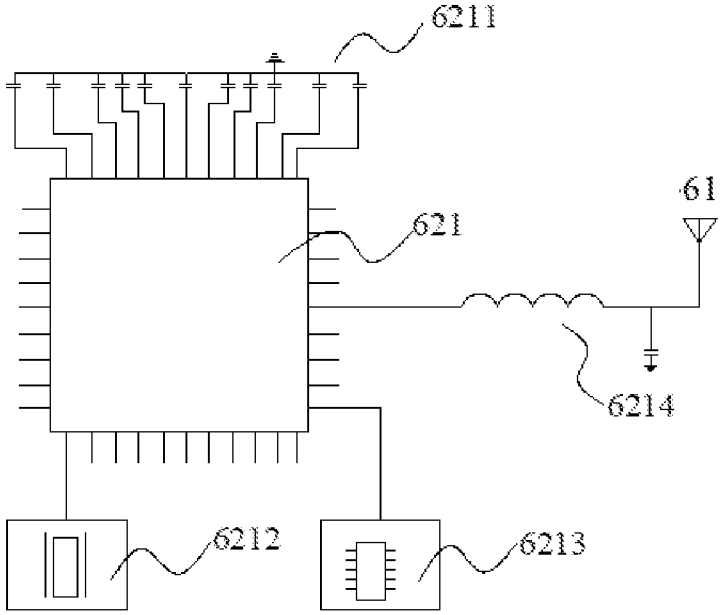
FIG. 6 is a circuit diagram of one conventional radio frequency chip.

Referring to FIG. 6, in one embodiment, the filter circuitry 6211, the crystal oscillator 6212 and the flash memory 6213 may be located outside the radio frequency integrated circuit 621.

In some embodiments, the antenna 61 is a unipolar antenna disposed on the first sub-board 41. The unipolar antenna may be a single wire only occupying very small space. In another example, the antenna 61 may be configured to be strip-shaped or at least one of a zigzag shape, a spiral shape, a stage shape or a ring shape according to the shape of the first sub-substrate 41. As such, the length of the antenna 61 can be flexibly adjusted to match different operating frequencies. The material of the antenna 61 may be at least one of gold, silver, copper, palladium, platinum, nickel, and stainless steel. In a specific application, different materials and different shapes of the antenna 61 may be configured according to different scenarios.

Referring to FIGS. 1-5, the LED module 5 includes at least one first LED 51 and a driver circuitry 52. The driver circuitry 52 electrically connects to the LED 51 so as to drive the LED 51. The driver circuitry 52 is arranged on the composite printed circuit board 4, that is, the driver circuitry 52 and the LED 51 are circuit-fused together. Such configuration is feasible for Driver on Board (DOB) lamp, which is usually referred to as "de-energizing," that is, the conventional AC/DC (AC to DC) rectifier is removed. The LED driving circuit and the LED string circuit are combined. The DOB uses high-voltage LEDs plus a streamlined high-voltage driving circuit, which can be directly driven by the main voltage, without the need of additional components such as inductors, electrolytic capacitors, and transformers. As such, the size and cost of the lamp may be reduced. In one embodiment, when there are many LEDs 51, the LEDs 51 may be configured to surround the second sub-board 42 so as to provide uniform light.

Figure 8:
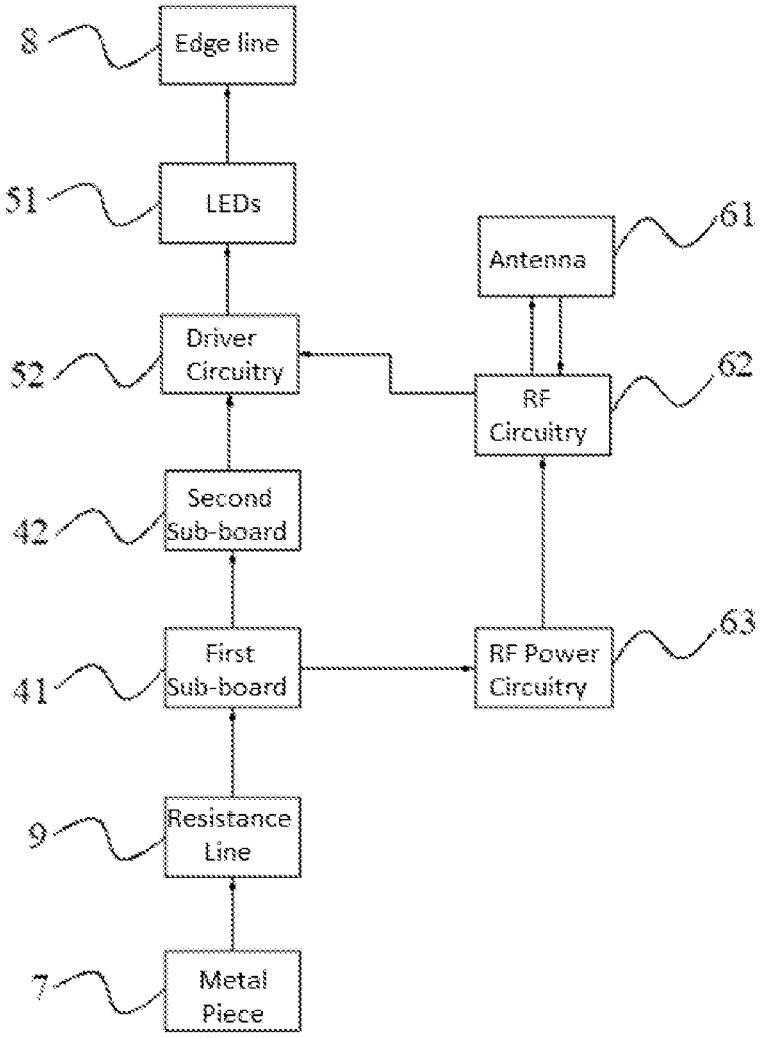
FIG. 8 is a block diagram of the LED lighting apparatus in accordance with one embodiment of the present disclosure.

Referring to FIG. 8, in one embodiment, the power may be supplied to the LED 51 by the path described below. The alternating current of the external power source reaches the first sub-board 41 through the metal piece 7 and the resistance line 9 of the head body 2. The alternating current is then transmitted to the second sub-board 42 through the wires on the first sub-board 41, and then supplied to the LED 51 through the driver circuitry 52. Afterward, the alternating current is transmitted to the main body 1 through the edge line 8, and back to the head body 2 to form a complete circuit.

The power may be supplied to the antenna 61 by the path described below. The alternating current of the external power source is transmitted to the first sub-board 41 via the metal piece 7 and the resistance line 9 of the head body 2 so as to provide the power to the radio frequency power circuitry 63. The alternating current is then supplied to the radio frequency circuitry 62 through the radio frequency power circuitry 63. The radio frequency circuit 62 then supplies the power to the antenna 61.

The signals may be provided to the radio frequency circuitry 62 by the path described below. The antenna 61 receives the signals and transforms the signals into electronic signals. The electronic signals are then transmitted to the radio frequency circuitry 62 via the wires on the first sub-board 41.

The LED module 5 may be driven by the communication module 6. In one example, the radio frequency circuitry 62 controls the driver circuitry 52 in accordance with the control signals so as to drive the LED 51.

The assembly process of the lamp will be described in detail below. First, the assembled composite printed circuit board 4, the resistance line 9, and the edge line 8 are applied with the wave soldering process. After the wave soldering process, the resistance line 9, the edge line 8, and the composite printed circuit board 4 are fixed together with solder paste.

Next, the resistance line 9 of the composite printed circuit board 4 is aligned with the middle of the main body 1, and the edge line 8 is aligned with the socket 12 at the bottom of the main body 1. The composite printed circuit board 4 is placed on the ring-shaped stage 131 inside the main body 1, and the composite printed circuit board 4 is riveted and connected together via the jig. The interference fit between the two is between 0 and 0.1 mm. In a specific application, the interference gap may be 0, 0.05 mm or 0.1 mm. After the head body 2 and the metal piece 7 are assembled, the head body 2 is riveted to meet the requirements of the torsion and bending moment. In this way, the head body 2 is prevented from falling off. Lastly, a ring of silicone adhesive or the like is applied to the other end of the main body 1, and the bulb body 3 is assembled. After the silicone glue dries, the bulb body 3 may be fixed on the main body 1.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a main body;

a bulb body connected to a first end of the main body;

a head body connected to a second end of the main body, and is configured to be connected to an electrical socket for receiving power;

a light LED module for emitting light;

a communication module for providing wireless communication;

a composite printed circuit board, wherein the communication module and the light LED module are located on the composite printed circuit board, wherein the communication module further comprises an antenna, a radio frequency circuitry coupled to the antenna for receiving wireless signals, and a radio frequency power circuitry for providing power to the radio frequency circuitry, wherein the radio frequency circuitry further comprises a radio frequency integrated circuit and an antenna impedance matching circuitry electrically connected to the antenna, wherein the light LED module further comprises at least one light emitting diode and a driver circuitry electrically connected to the at least one light emitting diode to enable the at least one light emitting diode to emit light.

2. The lighting apparatus of claim 1, wherein the radio frequency integrated circuit further comprises a crystal oscillator and a flash memory.

3. The lighting apparatus of claim 1, wherein the radio frequency circuitry further comprises a radio frequency integrated circuit, a crystal oscillator, a flash memory, and an antenna impedance matching circuitry electrically connected to the antenna.

4. The lighting apparatus of claim 1, wherein the main body further comprises a plastic coated aluminum structure.

5. The lighting apparatus of claim 1, wherein composite printed circuit board has a first sub-board for mounting the light LED module and a second sub-board for mounting the communication module, the first sub-board and the second sub-board are two different boards.

6. The lighting apparatus of claim 5, wherein the first sub-board includes an insulating substrate, and the second sub-board includes a metal substrate.

7. The lighting apparatus of claim 5, wherein the second sub-board physically surrounds the first sub-board, and the first sub-board and the second sub-board are physically arranged in a same plane.

8. The lighting apparatus of claim 5, wherein the first sub-board includes a first layer and a second layer physically arranged above the first layer, and the first layer of the first sub-board and the second sub-board are physically arranged in a same plane.

9. The lighting apparatus of claim 8, wherein the communication module includes an antenna, a radio frequency circuitry coupled to the antenna for receiving wireless signals, and a radio frequency power circuitry for providing power to the radio frequency circuitry, wherein the radio frequency power circuitry is arranged on the first layer of the first sub-board, and the antenna and the radio frequency circuitry are arranged on the second layer of the first sub-board.

10. The lighting apparatus of claim 1, wherein the first sub-board includes a first layer, a second layer physically arranged above the first layer, and a third layer physically arranged above the second layer, wherein the first layer of the first sub-board and the second sub-board are physically arranged in a same plane.

11. The lighting apparatus of claim 10, wherein the communication module includes an antenna, a radio frequency circuitry coupled to the antenna for receiving wireless signals, and a radio frequency power circuitry for providing power to the radio frequency circuitry, wherein the antenna and the radio frequency circuitry are arranged in a first plane, and the radio frequency power circuitry is arranged in a second plane different from the first plane.

12. The lighting apparatus of claim 11, wherein the communication module includes an antenna, a radio frequency circuitry coupled to the antenna for receiving wireless signals, and a radio frequency power circuitry for providing power to the radio frequency circuitry, wherein the radio frequency power circuitry is arranged on the first layer of the first sub-board, the radio frequency circuitry is arranged on the second layer of the first sub-board, and the antenna is arranged on the third layer of the first sub-board.

* * * * *